United States Patent [19]

Price

[11] Patent Number: 4,949,482

[45] Date of Patent: Aug. 21, 1990

[54] QUADRILATERAL POP-UP PRODUCT

[75] Inventor: Frederick F. Price, Chicago, Ill.

[73] Assignee: The Wessel Company, Elk Grove Village, Ill.

[21] Appl. No.: 371,628

[22] Filed: Jun. 26, 1989

[51] Int. Cl.[5] ..... G09F 1/00

[52] U.S. Cl. ..... 40/124.1; 40/539

[58] Field of Search ..... 40/124.1, 530, 539

[56] References Cited

U.S. PATENT DOCUMENTS

| | | | |
|---|---|---|---|
| Re. 22,109 | 6/1942 | Hayes | 46/35 |
| 1,913,797 | 6/1933 | Dulin et al. . | |
| 2,113,238 | 4/1938 | Ouwerkerk | 40/124.1 |
| 2,152,299 | 3/1934 | Arndt | 40/126 |
| 2,511,211 | 6/1950 | Klein et al. | 40/7 |
| 2,742,723 | 4/1956 | Klein et al. | 40/126 |
| 4,103,444 | 8/1978 | Jones et al. | 40/124 |

FOREIGN PATENT DOCUMENTS

| | | | |
|---|---|---|---|
| 238396 | 8/1925 | United Kingdom | 40/124.1 |
| 609448 | 9/1948 | United Kingdom | 40/124.1 |

*Primary Examiner*—Laurie K. Cranmer

*Attorney, Agent, or Firm*—Marshall, O'Toole, Gerstein, Murray & Bicknell

[57] ABSTRACT

The present device is a folded, printed product of the type often used in advertising. The product lies flat when closed, but when open or unfolded, a section of the product forms a three-dimensional box. The box section has a tongue extending above it, providing a particularly prominent section for displaying important information.

3 Claims, 1 Drawing Sheet

QUADRILATERAL POP-UP PRODUCT

BACKGROUND OF THE INVENTION

The present invention relates to folded printed material which becomes three-dimensional when in the open position but which remains substantially two-dimensional when closed.

It is often desirable that advertising or other printed material have a three-dimensional or pop-up section. Pop-up sections attract the attention of the viewer, thus enhancing the chances that the product's printed material will be thoroughly read. Because pop-up products are relatively uncommon, they are more likely to be remembered by the viewer than is other printed material.

Pop-up products must remain substantially flat when in the closed position so that they can be easily and economically transported and distributed. The flatness of the product in the closed position also serves to highlight the effect of the pop-up.

Generally, the manufacture of pop-up products requires a number of steps often including printing, perforating, cutting, gluing, and folding. In order for the product to be manufactured economically, it must be designed so that it can be produced without substantial amounts of manual labor.

SUMMARY OF THE INVENTION

The present invention is composed of two sheets of material, usually paper, which may contain printed material. The two sheets can be formed from one larger sheet which is first printed and then cut into two sheets. The first of these sheets is folded along four creases so that five panels are formed. The sheets may be perforated so that they can be easily folded. In one embodiment of the present invention, the second sheet may be folded to form two panels.

The panels of the first sheet are sized and arranged so that a box with open ends is formed, and the edges of the box form a parallelogram. A tongue section is formed from one of the panels, and attached to the other panels in such a manner that when the pop-up is opened, the tongue section extends above the box-forming or quadrilateral section of the product. Because the tongue section is particularly prominent, it can be imprinted with written or pictorial material which is to be emphasized.

The second sheet is glued to the first sheet and serves as means for opening the pop-up product. Once the pop-up product is opened, a panel of the second sheet can be unfolded from the second sheet, thus providing additional space for printed material.

In the closed position, the pop-up product is substantially flat. The panels which form the box collapse on top of each other when the pop-up product is closed.

Other features and advantages are inherent in the product claimed and disclosed or will become apparent to those skilled in the art from the following detailed description in conjunction with the accompanying diagrammatic drawings.

DETAILED DESCRIPTION

Figure 1:
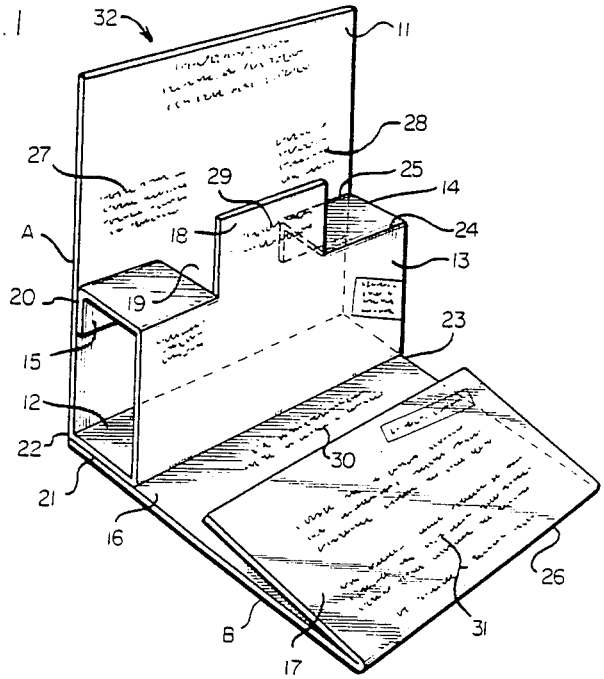
FIG. 1 is a perspective view of the pop-up product in an open position.
Figure 2:
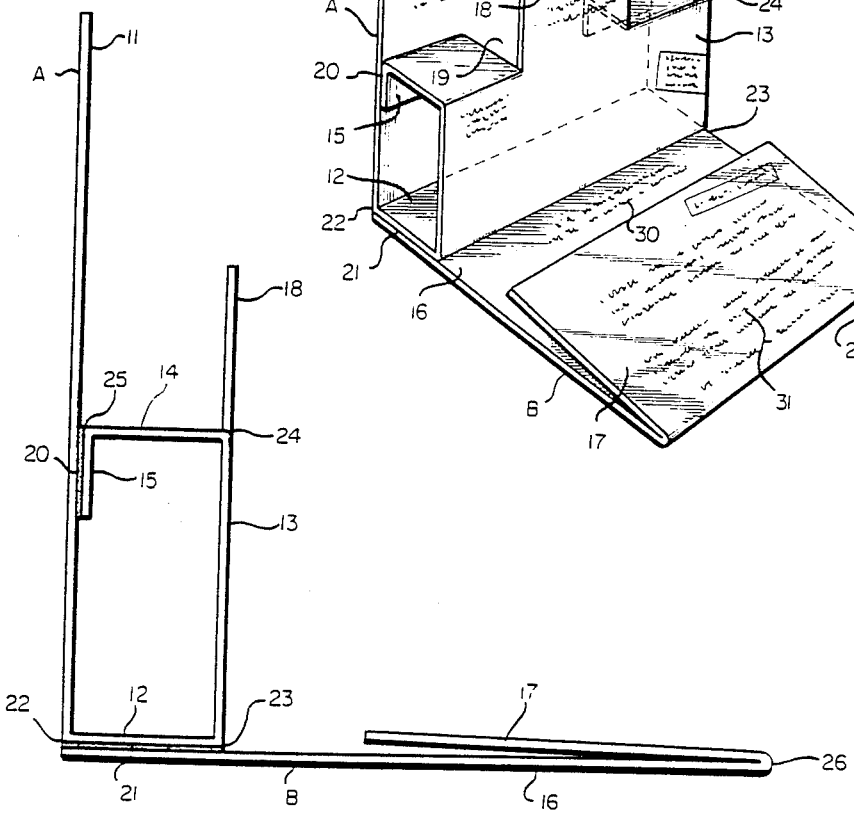
FIG. 2 is an end view of the pop-up product in an open position.
Figure 3:
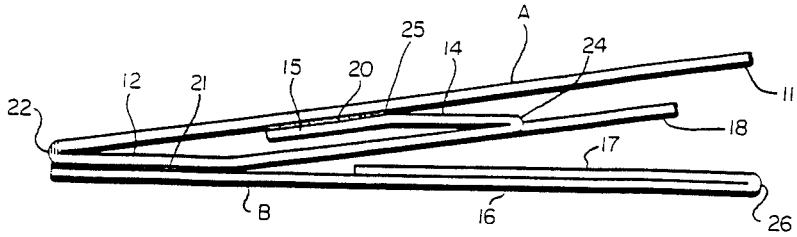
FIG. 3 is an end view of the pop-up product in a substantially closed position.

Referring to FIGS. 1–3, indicated generally at 32 is a pop-up product constructed in accordance with an embodiment of the present invention. Pop-up product 32 is made from two sheets, A and B. Sheet A is folded along crease lines 22, 23, 24, and 25. These crease lines divide sheet A into panels 11, 12, 13, 14, and 15. Panel 15 is attached to a mid-section of panel 11 with adhesive 20. In the embodiment of the present invention depicted in FIGS. 1–3, the length (measured from crease line to crease line) of panel 12 and the length of panel 14 are substantially equal, and the length of panel 13 is substantially equal to the distance from crease line 22 to the line where crease line 25 is adhered to panel 11. Thus, as viewed in FIG. 2, the edges of panels 12, 13, and 14 and the section of panel 11 below where crease line 25 is attached to panel 11, in this embodiment of the invention, form a parallelogram.

Tongue 18 is cut out from panel 14 leaving opening 19 in panel 14. Tongue 18 remains connected to sheet A at the junction between panels 13 and 14. There is no crease at the junction between tongue 18 and panel 13 so that tongue 18 and panel 13 are always coplaner. When the pop-up product 32 is in the open position of FIGS. 1 and 2, tongue 18 becomes particularly prominent, being both above panel 14 and separated from and in front of panel 11.

Sheet B is attached to sheet A along panel 12 of sheet A, with adhesive 21. Sheet B may be folded at crease line 26 thus forming panels 16 and 17. Panel 16 in this embodiment is approximately the same size as panel 11. Panel 11 can be made slightly longer than panel 16 so that panel 11 can be easily separated from panel 16 when the pop-up product is in the closed position. If sheet A is folded, panel 17 must be no longer than the length of panel 16 less the length of panel 12 so that panel 17 can fold easily under panel 13 and tongue 18 when the pop-up product is in the closed position.

The pop-up product may be imprinted with written or pictorial material such as 27, 28, 29, 30, and 31.

FIG. 3 shows the pop-up product in a nearly closed position. In the closed position the various panels collapse on top of each other to form a substantially flat stack.

The foregoing detailed description has been given for clearness of understanding only, and no unnecessary limitations should be understood therefrom as modifications will be obvious to those skilled in the art.

What is claimed is:

1. A pop-up product comprising:

first and second sheets of material;

a first sheet folded along four crease lines to form five panels;

said first sheet comprising a first panel connected by a first crease line to a second panel connected by a second crease line to a third panel connected by a third crease line to a fourth panel connected by a fourth crease line to a fifth panel;

said fifth panel of said first sheet being attached to said first panel along a mutual area of attachment on each of said panels;

a quadrilateral defined by the edges of said second, third, and fourth panels and the edge of said first panel from said first crease line to and including the area where the fifth panel is mutually attached to the first panel;

a tongue formed by cutting out a section of the fourth panel;

said tongue being attached to said first sheet at a junction between the third and fourth panels;

there being no crease line at said junction so that said tongue remains coplaner with the third panel;

said second sheet being adhered to the first sheet along the second panel of said first sheet.

2. The pop-product of claim 1 wherein:

said second sheet is folded along a crease to form first and second panels on said second sheet;

said second panel being no longer than the length of the first panel of said second sheet less the length of the second panel of the first sheet.

3. A pop-up product as recited in claim 1 wherein said panels contain printed material.

* * * * *